US009303237B2

(12) United States Patent
Walters et al.

(10) Patent No.: US 9,303,237 B2
(45) **Date of Patent: *Apr. 5, 2016**

(54) BIODEGRADABLE STABILITY BINDING AGENT FOR A SOLID DETERGENT

(71) Applicant: Ecolab USA Inc., St. Paul, MN (US)

(72) Inventors: Kerrie E. Walters, Minneapolis, MN (US); Carter M. Silvernail, Burnsville, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/576,564

(22) Filed: Dec. 19, 2014

(65) Prior Publication Data

US 2015/0105314 A1 Apr. 16, 2015

Related U.S. Application Data

(63) Continuation of application No. 13/561,524, filed on Jul. 30, 2012, now Pat. No. 8,945,314.

(51) Int. Cl.

| | |
|---|---|
| ***C11D 1/722*** | (2006.01) |
| ***C11D 3/22*** | (2006.01) |
| ***C11D 3/37*** | (2006.01) |
| ***C11D 17/00*** | (2006.01) |

(52) U.S. Cl.

CPC ..... *C11D 3/222* (2013.01); *C11D 3/3703* (2013.01); *C11D 3/3715* (2013.01); *C11D 3/3788* (2013.01); *C11D 17/0047* (2013.01)

(58) Field of Classification Search

CPC ..... C11D 3/046; C11D 3/22; C11D 3/37; C11D 3/3788; C11D 1/722; B08B 3/04

See application file for complete search history.

(56) References Cited

U.S. PATENT DOCUMENTS

| | | | | |
|---|---|---|---|---|
| 5,223,171 | A * | 6/1993 | Jost et al. | 510/471 |
| 8,636,918 | B2 * | 1/2014 | Silvernail et al. | 252/175 |
| 8,679,366 | B2 * | 3/2014 | Silvernail et al. | 252/175 |
| 8,945,314 | B2 * | 2/2015 | Walters et al. | 134/22.13 |
| 2007/0021577 | A1 * | 1/2007 | Rodrigues et al. | 527/309 |
| 2008/0020961 | A1 * | 1/2008 | Rodrigues et al. | 510/475 |
| 2011/0136718 | A1 | 6/2011 | Rodrigues et al. | |
| 2012/0053110 | A1 | 3/2012 | Kiesel et al. | |
| 2012/0128608 | A1 | 5/2012 | Rodrigues et al. | |
| 2012/0190607 | A1 | 7/2012 | Olson et al. | |

FOREIGN PATENT DOCUMENTS

| | | |
|---|---|---|
| EP | 0188016 A1 | 7/1986 |
| EP | 0188017 A1 | 7/1986 |

OTHER PUBLICATIONS

European Patent Office, "Extended European Search Report" issued in connection to International Applicaiton No. 12882337.4, 8 pages, issued on Feb. 11, 2016.

* cited by examiner

*Primary Examiner* — Brian P Mruk

(74) *Attorney, Agent, or Firm* — McKee, Voorhees & Sease, PLC

(57) ABSTRACT

A solid composition includes a polysaccharide hybrid polymer composition and a hydratable salt. In one embodiment, the polysaccharide hybrid polymer composition includes a polysaccharide residue present in an amount from approximately 5% to 90% by weight of the polysaccharide hybrid polymer composition and a residue of at least one ethylenically unsaturated monomer present in an amount from approximately 10% to 75% by weight of the polysaccharide hybrid polymer composition.

25 Claims, No Drawings

BIODEGRADABLE STABILITY BINDING AGENT FOR A SOLID DETERGENT

CROSS-REFERENCE TO RELATED APPLICATIONS

This application is a continuation application of U.S. Ser. No. 13/561,524 filed Jul. 30, 2012, now U.S. Pat. No. 8,945,315 issued Feb. 3, 2015, which is hereby incorporated by reference in its entirety.

TECHNICAL FIELD

The present invention relates generally to the field of solid detergent compositions. In particular, the present invention relates to solid detergent compositions containing a hydratable salt and a polysaccharide hybrid polymer composition.

BACKGROUND

The use of solidification technology and solid block detergents in institutional and industrial operations was pioneered in the SOLID POWER® brand technology claimed in Fernholz et al., U.S. Reissue Pat. Nos. 32,762 and 32,818. Additionally, sodium carbonate hydrate cast solid products using substantially hydrated sodium carbonate materials was disclosed in Heile et al., U.S. Pat. Nos. 4,595,520 and 4,680,134.

In more recent years, attention has been directed to producing highly effective detergent materials from less caustic materials such as soda ash, also known as sodium carbonate. Early work in developing the sodium carbonate based detergents found that sodium carbonate hydrate-based materials often swelled, (i.e., were dimensionally unstable) after solidification. Such swelling can interfere with packaging, dispensing, and use. The dimensional instability of the solid materials relates to the unstable nature of various hydrate forms prepared in manufacturing the sodium carbonate solid materials. Early products made with hydrated sodium carbonate were typically comprised of anhydrous, a one mole hydrate, a seven mole hydrate, a ten mole hydrate or more mixtures thereof. However, after the product had been manufactured and stored at ambient temperatures, the hydration state of the initial product was found to shift between hydrate forms, e.g., one, seven, and ten mole hydrates, resulting in dimensional instability of the block chemicals. In these conventional solid form compositions, changes in water content and temperature lead to structural and dimensional change, which may lead to a failure of the solid form, resulting in problems such as the inability of the solid form to fit into dispensers for use.

Additionally, conventional solid alkaline detergents, particularly those intended for institutional and commercial use, generally require phosphates in their compositions. The phosphates typically serve multiple purposes in the compositions, for example, to control the rate of solidification, to remove and suspend soils, and as an effective hardness sequestrant. U.S. Pat. Nos. 6,258,765, 6,156,715, 6,150,324, and 6,177,392, disclose that a solid block functional material could be made using a binding agent that includes a carbonate salt, an organic acetate, such as an aminocarboxylate, or phosphonate component and water. Further work has recently been directed to replacing phosphorous-containing compounds in detergents. One replacement is nitrilotriacetic acid (NTA)-containing aminocarboxylate components, which can be used as a binding agent and/or hardness sequestrant. However, the use of NTA has also been curtailed.

There is an ongoing need to provide alternative solidification technologies which are phosphorous-free and/or NTA-free. However, the lack of predictability in the solidification process and the lack of predictability of dimensional stability in solid form compositions have hampered efforts to successfully replace phosphorous and/or NTA-containing components with more environmentally friendly substitutes.

SUMMARY

The present invention includes a dimensionally stable solid detergent composition. The composition includes a polysaccharide hybrid polymer composition and at least one hydratable salt. In one embodiment, the polysaccharide hybrid polymer composition includes a polysaccharide residue present in an amount from approximately 5% to 90% by weight of the polysaccharide hybrid polymer composition and a residue of at least one ethylenically unsaturated monomer or salts thereof present in an amount from approximately 10% to 75% by weight of the polysaccharide hybrid polymer composition.

In another embodiment, the solid detergent composition is used by mixing water with the composition to form a use solution. The substrate is contacted with the use solution. In some embodiments, the water and composition are mixed so that the use solution has a polysaccharide hybrid polymer composition concentration from about 1 part-per-million (ppm) to about 500 ppm.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

The present invention provides solid, dimensionally stable, detergent compositions including a polysaccharide hybrid polymer composition, water and a hydratable salt. The solid compositions can be biodegradable and substantially free of phosphorous containing components to comply with various regulatory requirements.

The present compositions can be used in any environment in which it is desirable to form a dimensionally stable solid detergent composition. Example applications include warewashing, laundering, institutional, health care, food and beverage, and water treatment applications. More particularly, example applications include, but are not limited to: machine and manual warewashing, presoaks, laundry and textile cleaning and destaining, carpet cleaning and destaining, surface cleaning and destaining, kitchen and bath cleaning and destaining, floor cleaning and destaining, cleaning in place operations, general purpose cleaning and destaining, industrial or household cleaners, and industrial or municipal water systems. The present compositions may also be used as textile scours, mineral deposition, or in oilfield applications, such as for scale inhibition or drilling aids. Methods of using the composition are also provided. Methods of forming and using the composition are also provided.

The solid detergent compositions generally include a polysaccharide hybrid polymer composition, water and a hydratable salt. The polysaccharide hybrid polymer composition includes residue of a polysaccharide and residue of at least one ethylenically unsaturated monomer or salts thereof. In some embodiments, the polysaccharide hybrid polymer is anionic. In another embodiment the polysaccharide hybrid polymer is a copolymer.

The polysaccharide hybrid polymer compositions of the present invention are produced by polymerizing with free radical initiators at least one ethylenically unsaturated monomer in the presence of the polysaccharide as a chain transfer agent, such as described in U.S. Pat. No. 7,666,963 and PCT Publication No. WO 2011/014783, each of which is incorporated by reference in its entirety herein. The polymerization is initiated by a non-metal or a non-metal ion initiator, such as inorganic peroxides including, but not limited to, hydrogen peroxide, sodium persulfate, potassium persulfate and ammonium persulfate.

As described herein, a "hybrid polymer composition" is a mixture of (a) a hybrid synthetic polymer and (b) a hybrid polymer. The hybrid polymer composition of the present invention thus contains at least the two moieties, (a) and (b), with a minimum amount of the hybrid synthetic polymer (a) since this component generates the chain transfer which leads to the formation of the hybrid polymer (b). One skilled in the art will recognize that the hybrid polymer composition may contain a certain amount of the unreacted naturally derived hydroxyl containing chain transfer agent. Suitable hybrid polymer compositions are described in PCT Publication No. WO 2011/014783. The term "hybrid polymer", as defined herein, refers to a polymer of ethylenically unsaturated monomers with an end group containing the naturally derived hydroxyl containing chain transfer agent which is a result of the hybrid synthetic polymer chain transfer. Also as used herein, the term "hybrid synthetic polymer" is a synthetic polymer derived from synthetic monomers with a hybrid initiator fragment as one end group. The other end group is a proton resulting from chain transfer to the naturally derived hydroxyl containing chain transfer agent. As used herein, the term "synthetic monomer" means any ethylenically unsaturated monomer which can undergo free radical polymerization. In an embodiment, the hybrid polymer composition suitable for use in this invention is an anionic hybrid polymer composition.

Polymerization may change a component from its original structure to a derivative structure. As used herein, the term "residue" refers to the starting component or anything derived from the component during polymerization which is part of the polymer. For example, a residue of acrylic acid includes acrylic acid and anything derived from acrylic acid during polymerization which is part of the polymer. In one example, the polysaccharide hybrid polymer composition can have a weight average molecular weight from about 2,000 g/mol to about 25,000 g/mol, in other embodiments from about 5,000 g/mol to about 20,000 g/mol and in yet another embodiment from about 7,000 to about 15,000 g/mol. The weight average molecular weight may be determined by several methods, with Gel Permeation Chromatography (GPC) using the appropriate methods and standards as the preferred method.

The residue of a polysaccharide includes a polysaccharide and anything derived from the polysaccharide during polymerization which is part of the polysaccharide hybrid polymer composition. Suitable polysaccharides can be derived from plant, animal and microbial sources. Example polysaccharides include but are not limited to maltodextrins, starches, cellulose, gums (e.g., gum arabic, guar and xanthan), alginates, pectin and gellan. Suitable starches include those derived from maize, potato, tapioca, wheat, rice, pea, sago, oat, barley, rye, and amaranth, including conventional hybrids or genetically engineered materials. Additional example polysaccharides include hemicellulose or plant cell wall polysaccharides such as D-xylans.

The polysaccharides can be modified or derivatized by etherification (e.g., via treatment with propylene oxide, ethylene oxide, 2,3-epoxypropyltrimethylammonium chloride), esterification (e.g., via reaction with acetic anhydride, octenyl succinic anhydride ('OSA')), acid hydrolysis, dextrinization, oxidation or enzyme treatment (e.g., starch modified with α-amylase, β-amylase, pullanase, isoamylase or glucoamylase), or various combinations of these treatments.

The polysaccharide hybrid polymer composition also includes residue of at least one ethylenically unsaturated monomer or salts thereof. In some examples, the at least one ethylenically unsaturated monomer can include at least one anionic ethylenically unsaturated monomer. Examples of anionic ethylenically unsaturated monomers include but are not limited to acrylic acid, methacrylic acid, ethacrylic acid, α-chloro acrylic acid, α-cyano acrylic acid, β-methyl-acrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid and maleic acid. The anionic ethylenically unsaturated monomers may include half esters of maleic and itaconic acid such as monomethyl, monoethyl, monopropyl, monobutyl, monoisopropyl and monotertbutyl maleate, and monomethyl, monoethyl, monopropyl, monobutyl, monoisopropyl and monotertbutyl itaconate. Moieties such as maleic anhydride or acrylamide that can be derivatized to an acid containing group can be used. Combinations of anionic ethylenically unsaturated monomers can also be used. In a preferred embodiment, the anionic ethylenically unsaturated monomers include acrylic acid, maleic acid, methacrylic acid, 2-acrylamido-2-methyl propane sulfonic acid, monomethyl maleate and/or mixtures thereof or their salts. In a more preferred embodiment, the acid-containing monomers are acrylic acid and/or methacrylic acid. As an example, the anionic polysaccharide hybrid polymer composition includes acrylic acid residue. The residue of acrylic and methacrylic acid may be derived from acrylic and methacrylic acid monomers or may be generated from a hydrolyzable monomer. For example, a methacrylic acid residue may be partially or completely hydrolyzed from methyl methacrylate. The residues of acrylic acid and methacrylic acid may also be present as lithium, sodium, and potassium salts, ammonium and amine salts. The polysaccharide hybrid polymer composition may optionally include residue of another ethylenically unsaturated monomers. In an embodiment, such other ethylenically unsaturated monomers are hydrophilic. Examples of other ethylenically unsaturated monomers include but are not limited to hydroxyalkyl (meth)acrylate or dialkyl maleate or dialkyl itaconate. A residue of hydroxyalkyl (meth)acrylate includes both hydroxyalkyl acrylate and hydroxyalkyl methacrylate. Examples of suitable hydroxyalkyl (meth)acrylates include but are not limited to hydroxymethyl, hydroxyethyl, hydroxypropyl, hydroxybutyl, hydroxyisopropyl and hydroxytertbutyl (meth)acrylates. Suitable dialkyl maleates include but are not limited to diethyl, dipropyl, dibutyl, diisopropyl and ditertbutyl maleate. Suitable dialkyl itaconates include but are not limited monomethyl, monoethyl, monopropyl, monobutyl, monoisopropyl and monotertbutyl itaconate.

The polysaccharide hybrid polymer composition may optionally include residue of more than one ethylenically unsaturated monomer. In an embodiment, the polysaccharide hybrid polymer composition includes residue of two ethylenically unsaturated monomers present in the polysaccharide hybrid polymer composition in weight ratios from about 1:5 to about 5:1. In a preferred embodiment, acrylic acid and maleic acid are present in the polysaccharide hybrid polymer composition in weight ratios from about 1:5 to about 5:1.

A suitable concentration range of the components of the polysaccharide hybrid polymer composition include from about 5% to 90% by weight polysaccharide residue and from about 10% to about 75% by weight of at least one ethylenically unsaturated monomer. A particularly suitable concentration range of the components in the polysaccharide hybrid polymer composition include from about 30% to about 80% by weight polysaccharide residue and from about 10% to about 70% by weight residue of at least one ethylenically unsaturated monomer, and more particularly from about 40% to about 70% by weight polysaccharide residue and from about 10% to about 50% by weight residue of at least one ethylenically unsaturated monomer. The component weight percentages of the polysaccharide hybrid polymer composition given above and in the examples are based on the amounts of the respective ingredients as originally added to the hybrid polymer composition. One skilled in the art will recognize that the weight percent of each component in the final polysaccharide hybrid polymer composition may vary due to the polymerization process.

Optionally, the polysaccharide hybrid polymer composition may include from about 0.5% to about 20%, and more preferably from about 1% to about 10%, by weight residue of hydroxyalkyl (meth)acrylate, and/or from about 1% to about 25%, and more preferably from about 2% to about 15%, by weight residue of mono or dialkyl maleate.

The polysaccharide hybrid polymer composition can be a bio-based and/or biodegradable polymer, which reduces the reliance on natural gas and/or petrochemical feedstocks. Biobased content is the amount of biobased carbon in a material or product and can be expressed as a percent of weight (mass) of the total organic carbon in the product. The biobased content can be determined using ASTM Method D6866, entitled Standard Test Methods for Determining the Biobased Content of Natural Range Materials Using Radiocarbon and Isotrope Ratio Mass Spectrometry Analysis. Biodegradability measures the ability of microorganisms present in the disposal environment to completely consume the biobased carbon product within a reasonable time frame and in a specified environment. Biodegradability of plastic materials can be determined using ASTM Method D5338, entitled Test Method for Determining Aerobic Biodegradation of Plastic Materials Under Controlled Composting Conditions. In one example, the polysaccharide hybrid polymer composition can include a polysaccharide and a reduced level of petrochemicals. For example, the detergent composition may include at least about 10 wt % biobased content. In another example, the detergent composition may include from about 10 wt % to about 80 wt % biobased content by weight. In another example, the detergent composition may include from about 15 wt % to about 75 wt % biobased content by weight.

The solid detergent compositions also include a hydratable salt. Suitable hydratable salts include sodium silicate, lithium silicate, potassium silicate, sodium metasilicate, sodium phosphate, calcium phosphate, magnesium phosphate, sodium pyrophosphate, sodium tripolyphosphate, sodium sulfate, sodium carbonate, sodium bicarbonate, sodium sesquicarbonate, sodium bisulfate, sodium thiosulfate, sodium percarbonate, or mixtures thereof. Example sodium carbonate compounds include but are not limited to synthetic light ash, natural light ash, dense ash and mono ash.

The solid detergent compositions may optionally include an alkali metal hydroxide. Suitable alkali metal hydroxides include but are not limited to: sodium hydroxide, potassium hydroxide, lithium hydroxide, and combinations thereof. The alkali metal hydroxide may be added to the composition in any form known in the art, including as solid beads, dissolved in an aqueous solution, or a combination thereof. Additionally, more than one alkalinity source may be used according to certain embodiments.

The alkali metal hydroxide controls the pH of the resulting solution when water is added to the solid composition to form a use solution. The pH of the use solution must be maintained in the alkaline range in order to provide sufficient detergency properties. In one embodiment, the pH of the use solution is from approximately 9 to approximately 13. Particularly, the pH of the use solution is from about 10 to about 12. If the pH of the use solution is too high, for example, above 13, the use solution may be too alkaline and attack or damage the surface to be cleaned.

The alkali metal hydroxide may also function as a hydratable salt to form a solid composition. The hydratable salt can be referred to as substantially anhydrous. By substantially anhydrous, it is meant that the component contains less than about 2% by weight water based upon the weight of the hydratable component. In other embodiments, the amount of water can be less than about 1% by weight, and in yet other embodiments, the amount of water can be less than about 0.5% by weight. In still yet other embodiments, the hydratable salt can be completely anhydrous.

The solid detergent compositions also include water of hydration to hydrate the hydratable salt and alkali metal hydroxide if present. It should be understood that the reference to water includes both water of hydration and free water. The phrase "water of hydration" refers to water which is somehow attractively bound to a non-water molecule. An exemplary form of attraction includes hydrogen bonding. The water of hydration also functions to increase the viscosity of the mixture during processing and cooling to prevent separation of the components. The amount of water of hydration in the composition will depend on the hydratable salt. In addition to water of hydration, the composition may also have free water which isn't attractively bound to a non-water molecule.

Water may be independently added to the detergent composition or may be provided in the solid composition as a result of its presence in an aqueous material that is added to the detergent composition. For example, materials added to the detergent composition may include water or may be prepared in an aqueous premix available for reaction with the solidification matrix component(s). Typically, water is introduced into the composition to provide the composition with a desired viscosity for processing prior to solidification and to provide a desired rate of solidification. The water may also be present as a processing aid and may be removed or become water of hydration. The water may thus be present in the form of aqueous solutions of the composition, or aqueous solutions of any of the other ingredients, and/or added aqueous medium as an aid in processing. In addition, it is believed that the aqueous medium may help in the solidification process when it is desired to form the concentrate as a solid. In an embodiment, the water may be provided as deionized water or as softened water.

The amount of water in the resulting solid detergent composition will depend on whether the solid detergent composition is processed through forming techniques or casting (solidification occurring within a container) techniques. In general, when the components are processed by forming techniques, it is believed that the solid detergent composition can include a relatively smaller amount of water for solidification compared with the casting techniques. When preparing the solid detergent composition by casting techniques, water may be present in ranges of from about 5% to about 50% by weight, particularly from about 10% to about 40% by weight, and more particularly from about 20% to about 40% by weight.

Suitable concentration ranges for the components in the solid detergent composition include at least about 40% by weight hydratable salt, from about 1% to about 20% by weight polysaccharide hybrid polymer composition and at least about 2% by weight water. Particularly suitable component concentrations for the solid detergent composition include at least about 50% by weight hydratable salt, from about 5% to about 15% by weight polysaccharide hybrid polymer composition and at least about 5% by weight water. More particularly suitable component concentrations for the solid detergent composition include at least about 60% by weight hydratable salt, from about 5% to about 15% by weight polysaccharide hybrid polymer composition and at least about 10% by weight water. In some embodiments, the solid detergent composition may include about 5% or less sodium hydroxide by weight of the solid detergent.

The actual solidification mechanism of the solid composition occurs through salt hydration. It is believed that the polysaccharide hybrid polymer composition functions to control the kinetics and thermodynamics of the solidification process and provides a solidification matrix in which additional functional materials may be bound to form a functional hydrate solid composition. The polysaccharide hybrid polymer composition may stabilize the salt hydrates and the functional solid composition by acting as a donor and/or acceptor of free water. By controlling the rate of water migration for hydration of the salt, the polysaccharide hybrid polymer composition may control the rate of solidification to provide process and dimensional stability to the resulting product. The rate of solidification is significant because if the solidification matrix solidifies too quickly, the composition may solidify during mixing and stop processing. If the solidification matrix solidifies too slowly, valuable process time is lost. The polysaccharide hybrid polymer composition also provides dimensional stability to the end product by ensuring that the solid product does not swell. If the solid detergent composition swells after solidification, various problems may occur, including but not limited to: decreased density, integrity, appearance, and inability to dispense or package the solid product. Generally, a solid product is considered to have dimensional stability if the solid product has a growth exponent (i.e., percent swelling) of less than about 3% and particularly less than about 2%. Growth exponent refers to the percent growth of a product over a period of time after solidification under normal transport/storage conditions. Because normal transport/storage conditions for detergent products may result in the solid detergent composition being subjected to an elevated temperature, the growth exponent may be determined by measuring one or more dimensions of the solid product prior to and after heating to from 100° F. to 122° F. for several hours, days or even weeks. The measured dimension depends on the shape of the solid detergent composition. For tablet shaped compositions, both diameter and height are generally measured. For capsule shaped compositions, only diameter is generally measured.

Embodiments of the present invention including a polysaccharide hybrid polymer composition may have a growth exponent that is less than the growth exponent of the same composition without such a polymer. More particularly, the present invention including a polysaccharide hybrid polymer composition may have a growth exponent that is less than about 3%, more particularly, less than about 2% when subjected to elevated temperatures of at least about 100° F., more particularly, about 122° F. More particularly, the growth exponent may remain below 2% even after heating at 122° F. for seven days. Even more particularly, the growth exponent may remain below 2% even after heating at 122° F. for at least two weeks.

The polysaccharide hybrid polymer composition is combined with water prior to incorporation into the detergent composition. The polysaccharide hybrid polymer composition should be in a water matrix when added to the detergent composition for the detergent composition to effectively solidify. In general, an effective amount of polysaccharide hybrid polymer composition is considered an amount that effectively controls the kinetics and thermodynamics of the solidification system by controlling the rate and movement of water. For example, in an embodiment, the polysaccharide hybrid polymer composition can be present in an amount from 0.5 wt % to about 25 wt %, based on total weight of the detergent composition. In another embodiment, the polysaccharide hybrid polymer can be present in an amount from 1.0 wt % to about 20 wt %, based on total weight of the detergent composition. In still other embodiments, the polysaccharide hybrid polymer can be present in an amount from 2.0 wt % to about 15 wt %, based on total weight of the detergent composition.

The solid detergent compositions of the present invention can be provided in any of a variety of embodiments of detergent compositions. In an embodiment, the detergent composition is substantially free of phosphorous, nitrilotriacetic acid (NTA) and ethylenediaminetetraacetic acid (EDTA). Substantially phosphorus-free means a composition having less than approximately 0.5 wt %, more particularly, less than approximately 0.1 wt %, and even more particularly less than approximately 0.01 wt % phosphorous based on the total weight of the composition. Substantially NTA-free means a composition having less than approximately 0.5 wt %, less than approximately 0.1 wt %, and particularly less than approximately 0.01 wt % NTA based on the total weight of the composition. When the composition is NTA-free, it is also compatible with chlorine, which functions as an anti-redeposition and stain-removal agent. When diluted to a use solution, the detergent composition includes phosphorous-containing components, NTA and EDTA concentrations of less than approximately 100 ppm, particularly less than approximately 10 ppm, and more particularly less than approximately 1 ppm.

Additional Functional Materials

The solid detergent composition can also include various additional functional components. In some embodiments, the polysaccharide hybrid polymer composition, water and the hydratable salt make up a large amount, or even substantially all of the total weight of the detergent composition, for example, in embodiments having few or no additional functional materials disposed therein. In one specific example, the composition consists essentially of the polysaccharide hybrid polymer composition, water and the hydratable salt. In these embodiments, the component concentration ranges provided above for the detergent are representative of the ranges of those same components in the detergent composition.

In alternative embodiments, functional materials are added to provide desired properties and functionalities to the composition. For the purpose of this application, the term "functional materials" includes a material that when dispersed or dissolved in a use and/or concentrate solution, such as an aqueous solution, provides a beneficial property in a particular use. Some particular examples of functional materials are discussed in more detail below, although the particular materials discussed are given by way of example only, and that a broad variety of other functional materials may be used. Moreover, the components discussed above may be multifunctional and may also provide several of the functional benefits discussed below.

Additional Alkali Sources

The composition can include one or more additional alkali sources. Examples of suitable additional alkali sources of the composition include, but are not limited to alkali metal carbonates, alkali metal hydroxides and alkali metal silicates. Exemplary alkali metal carbonates that can be used include, but are not limited to: sodium or potassium carbonate, bicarbonate, sesquicarbonate, and mixtures thereof. Exemplary alkali metal hydroxides that can be used include, but are not limited to: sodium or potassium hydroxide. The alkali metal hydroxide may be added to the composition in any form known in the art, including as solid beads, dissolved in an aqueous solution, or a combination thereof. Examples of alkali metal silicates include, but are not limited to sodium or potassium silicate or polysilicate, layered silicates, sodium or potassium metasilicate and hydrated sodium or potassium metasilicate or a combination thereof.

Surfactants

The solid detergent composition can include at least one cleaning agent comprising a surfactant or surfactant system. A variety of surfactants can be used in a solid detergent composition, including, but not limited to: anionic, nonionic, cationic, and zwitterionic surfactants. Surfactants are an optional component of the solid detergent composition and can be excluded from the concentrate. Exemplary surfactants that can be used are commercially available from a number of sources. For a discussion of surfactants, see Kirk-Othmer, Encyclopedia of Chemical Technology, Third Edition, volume 8, pages 900-912. When the solid detergent composition includes a surfactant as a cleaning agent, the cleaning agent is provided in an amount effective to provide a desired level of cleaning. The solid detergent composition, when provided as a concentrate, can include the surfactant cleaning agent in a range of about 0.05% to about 20% by weight, about 0.5% to about 15% by weight, about 1% to about 15% by weight, about 1.5% to about 10% by weight, and about 2% to about 8% by weight. Additional exemplary ranges of surfactant in a concentrate include about 0.5% to about 8% by weight, and about 1% to about 5% by weight.

Examples of anionic surfactants useful in the solid detergent composition include, but are not limited to: carboxylates such as alkylcarboxylates and polyalkoxycarboxylates, alcohol ethoxylate carboxylates, nonylphenol ethoxylate carboxylates; sulfonates such as alkylsulfonates, alkylbenzenesulfonates, alkylarylsulfonates, sulfonated fatty acid esters; sulfates such as sulfated alcohols, sulfated alcohol ethoxylates, sulfated alkylphenols, alkylsulfates, sulfosuccinates, and alkylether sulfates. Exemplary anionic surfactants include, but are not limited to: sodium alkylarylsulfonate, alpha-olefinsulfonate, and fatty alcohol sulfates.

Examples of nonionic surfactants useful in the solid detergent composition include, but are not limited to, those having a polyalkylene oxide polymer as a portion of the surfactant molecule. Such nonionic surfactants include, but are not limited to: chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated amines such as alkoxylated ethylene diamine; alcohol alkoxylates such as alcohol ethoxylate propoxylates, alcohol propoxylates, alcohol propoxylate ethoxylate propoxylates, alcohol ethoxylate butoxylates; nonylphenol ethoxylate, polyoxyethylene glycol ether; carboxylic acid esters such as glycerol esters, polyoxyethylene esters, ethoxylated and glycol esters of fatty acids; carboxylic amides such as diethanolamine condensates, monoalkanolamine condensates, polyoxyethylene fatty acid amides; and polyalkylene oxide block copolymers. An example of a commercially available ethylene oxide/propylene oxide block copolymer includes, but is not limited to, PLURONIC®, available from BASF Corporation, Florham Park, N.J. and BEROL® available from AkzoNobel Surface Chemistry, Chicago, Ill. An example of a commercially available silicone surfactant includes, but is not limited to, ABIL® B8852, available from Goldschmidt Chemical Corporation, Hopewell, Va.

Examples of cationic surfactants that can be used in the solid detergent composition include, but are not limited to: amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride. The cationic surfactant can be used to provide sanitizing properties.

Examples of zwitterionic surfactants that can be used in the solid detergent composition include, but are not limited to: betaines, imidazolines, and propionates.

Because the solid detergent composition is intended to be used in an automatic dishwashing or warewashing machine, the surfactants selected, if any surfactant is used, can be those that provide an acceptable level of foaming when used inside a dishwashing or warewashing machine. Solid detergent compositions for use in automatic dishwashing or warewashing machines are generally considered to be low-foaming compositions. Low foaming surfactants that provide the desired level of detersive activity are advantageous in an environment such as a dishwashing machine where the presence of large amounts of foaming can be problematic. In addition to selecting low foaming surfactants, defoaming agents can also be utilized to reduce the generation of foam. Accordingly, surfactants that are considered low foaming surfactants can be used. In addition, other surfactants can be used in conjunction with a defoaming agent to control the level of foaming.

Builders or Water Conditioners

The solid detergent composition can include one or more building agents, also called chelating or sequestering agents (e.g., builders), including, but not limited to: condensed phosphates, alkali metal carbonates, phosphonates, aminocarboxylic acids, and/or polyacrylates. In general, a chelating agent is a molecule capable of coordinating (i.e., binding) the metal ions commonly found in natural water to prevent the metal ions from interfering with the action of the other detersive ingredients of a cleaning composition. Preferable levels of addition for builders that can also be chelating or sequestering agents are from about 0.1% to about 70% by weight, about 1% to about 60% by weight, or about 1.5% to about 50% by weight. If the solid detergent is provided as a concentrate, the concentrate can include from approximately 1% to approximately 60% by weight, from approximately 3% to approximately 50% by weight, and from approximately 6% to approximately 45% by weight of the builders. Additional ranges of the builders include from approximately 3% to approximately 20% by weight, from approximately 6% to approximately 15% by weight, from approximately 25% to approximately 50% by weight, and from approximately 35% to approximately 45% by weight, based on total weight of the composition.

Examples of condensed phosphates include, but are not limited to: sodium and potassium orthophosphate, sodium and potassium pyrophosphate, sodium tripolyphosphate, and sodium hexametaphosphate. A condensed phosphate may also assist, to a limited extent, in solidification of the solid detergent composition by fixing the free water present in the composition as water of hydration.

Examples of phosphonates included, but are not limited to: 2-phosphonobutane-1,2,4-tricarboxylic acid (PBTC), 1-hydroxyethane-1,1-diphosphonic acid, $CH_2C(OH)[PO(OH)_2]_2$ (HEPD); aminotri(methylenephosphonic acid), $N[CH_2PO(OH)_2]_3$; aminotri(methylenephosphonate), sodium salt (ATMP), $N[CH_2PO(ONa)_2]_3$; 2-hydroxyethyliminobis(methylenephosphonic acid), $HOCH_2CH_2N[CH_2PO(OH)_2]_2$; diethylenetriaminepenta(methylenephosphonic acid), $(HO)_2POCH_2N[CH_2CH_2N[CH_2PO(OH)_2]_2]_{-2}$; diethylenetriaminepenta(methylenephosphonate), sodium salt (DTPMP), $C_9H_{(28-x)}N_3Na_xO_{15}P_5$ (x=7); hexamethylenediamine(tetramethylenephosphonate), potassium salt, $C_{10}H_{(28-x)}N_2K_xO_{12}P_4$ (x=6); bis(hexamethylene)triamine(pentamethylenephosphonic acid), $(HO_2)POCH_2N[(CH_2)_2N[CH_2PO(OH)_2]_2]_{-2}$; and phosphorus acid, $H_3PO_3$. A preferred phosphonate combination is ATMP and DTPMP. A neutralized or alkali phosphonate, or a combination of the phosphonate with an alkali source prior to being added into the mixture such that there is little or no heat or gas generated by a neutralization reaction when the phosphonate is added is preferred. In one embodiment, however, the detergent composition if free of phosphorous.

Useful aminocarboxylic acid materials containing little or no NTA include, but are not limited to: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), methylglycinediacetic acid (MGDA), glutamic acid-N,N-diacetic acid (GLDA), ethylenediaminesuccinic acid (EDDS), 2-hydroxyethyliminodiacetic acid (HEIDA), iminodisuccinic acid (IDS), 3-hydroxy-2-2'-iminodisuccinic acid (HIDS) and other similar acids or salts thereof having an amino group with a carboxylic acid substituent. In one embodiment, however, the composition if free of aminocarboxylates.

Water conditioning polymers can be used as non-phosphorus containing builders. Exemplary water conditioning polymers include, but are not limited to: polycarboxylates. Exemplary polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. Other suitable water conditioning polymers include starch, sugar or polyols comprising carboxylic acid or ester functional groups. Exemplary carboxylic acids include but are not limited to maleic, acrylic, methacrylic and itaconic acid or salts thereof. Exemplary ester functional groups include aryl, cyclic, aromatic and $C_1$-$C_{10}$ linear, branched or substituted esters. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers.

Hardening Agents

The compositions can also include a hardening agent in addition to, or in the form of, the builder. A hardening agent is a compound or system of compounds, organic or inorganic, which significantly contributes to the uniform solidification of the composition. Preferably, the hardening agents are compatible with the cleaning agent and other active ingredients of the composition and are capable of providing an effective amount of hardness and/or aqueous solubility to the processed composition. The hardening agents should also be capable of forming a homogeneous matrix with the cleaning agent and other ingredients when mixed and solidified to provide a uniform dissolution of the cleaning agent from the composition during use.

The amount of hardening agent included in the composition will vary according to factors including, but not limited to: the type of composition being prepared, the ingredients of the composition, the intended use of the composition, the quantity of dispensing solution applied to the solid composition over time during use, the temperature of the dispensing solution, the hardness of the dispensing solution, the physical size of the composition, the concentration of the other ingredients, and the concentration of the cleaning agent in the composition. It is preferred that the amount of the hardening agent included in the composition is effective to combine with the cleaning agent and other ingredients of the composition to form a homogeneous mixture under continuous mixing conditions and a temperature at or below the melting temperature of the hardening agent.

It is also preferred that the hardening agent form a matrix with the cleaning agent and other ingredients which will harden to a solid form under ambient temperatures of approximately 30° C. to approximately 50° C., particularly approximately 35° C. to approximately 45° C., after mixing ceases and the mixture is dispensed from the mixing system, within approximately 1 minute to approximately 3 hours, particularly approximately 2 minutes to approximately 2 hours, and particularly approximately 5 minutes to approximately 1 hour. A minimal amount of heat from an external source may be applied to the mixture to facilitate processing of the mixture. It is preferred that the amount of the hardening agent included in the composition is effective to provide a desired hardness and desired rate of controlled solubility of the processed composition when placed in an aqueous medium to achieve a desired rate of dispensing the cleaning agent from the solidified composition during use.

The hardening agent may be an organic or an inorganic hardening agent. A preferred organic hardening agent is a polyethylene glycol (PEG) compound. The solidification rate of compositions comprising a polyethylene glycol hardening agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly from approximately 1,450 to approximately 8,000. The polyethylene glycol is present at a concentration of from approximately 1% to 75% by weight and particularly approximately 3% to approximately 15% by weight, based on total weight of the composition. Suitable polyethylene glycol compounds include, but are not limited to: PEG 4000, PEG 1450, and PEG 8000 among others, with PEG 4000 and PEG 8000 being most preferred. An example of a commercially available solid polyethylene glycol includes, but is not limited to: CARBOWAX, available from Union Carbide Corporation, Houston, Tex.

Preferred inorganic hardening agents are hydratable inorganic salts, including, but not limited to: sulfates, carbonates and bicarbonates. The inorganic hardening agents are present at concentrations of up to approximately 50% by weight, from approximately 5% to approximately 50% by weight, particularly approximately 5% to approximately 25% by weight, and more particularly approximately 5% to approximately 15% by weight, based on total weight of the composition. In one embodiment, however, the solid composition if free of sulfates and carbonates including soda ash.

Urea particles can also be employed as hardeners in the compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the composition is effective to provide a desired hardness and desired rate of solubility of the composition when placed in an aqueous medium to achieve a desired rate of dispensing the cleaning agent from the solidified composition during use. In some embodiments, the composition includes from approximately 5% to approximately 90% by weight urea, particularly from approximately 8% to approximately 40% by weight urea, and more particularly from approximately 10% to approximately 30% by weight urea, based on total weight of the composition.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Bleaching Agents

Bleaching agents suitable for use in the composition for lightening or whitening a substrate include bleaching compounds capable of liberating an active halogen species, such as $Cl_2$, $Br_2$, —$OCl^-$ and/or —$OBr^-$, under conditions typically encountered during the cleansing process. Suitable bleaching agents for use in the compositions include, but are not limited to: chlorine-containing compounds such as chlorine, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine. When the concentrate includes a bleaching agent, it can be included in an amount from approximately 0.1% to approximately 60% by weight, from approximately 1% to approximately 20% by weight, from approximately 3% to approximately 8% by weight, and from approximately 3% to approximately 6% by weight, based on total weight of the composition.

Fillers

The composition can include an effective amount of detergent fillers which do not perform as a cleaning agent per se, but cooperates with the cleaning agent to enhance the overall cleaning capacity of the composition. Examples of detergent fillers suitable for use in the present cleaning compositions include, but are not limited to: sodium sulfate and sodium chloride. When the concentrate includes a detergent filler, it can be included in an amount up to approximately 50% by weight, from approximately 1% to approximately 30% by weight, or from approximately 1.5% to approximately 25% by weight, based on total weight of the composition.

Defoaming Agents

A defoaming agent for reducing the stability of foam may also be included in the composition. Examples of defoaming agents include, but are not limited to: ethylene oxide/propylene block polymers such as those available under the name Pluronic® N-3 available from BASF Corporation, Florham Park, N.J.; silicone compounds such as silica dispersed in polydimethylsiloxane, polydimethylsiloxane, and functionalized polydimethylsiloxane such as those available under the name Abil® B9952 available from Goldschmidt Chemical Corporation, Hopewell, Va.; fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated herein by reference. When the concentrate includes a defoaming agent, the defoaming agent can be provided in an amount from approximately 0.0001% to approximately 10% by weight, from approximately 0.001% to approximately 5% by weight, or from approximately 0.01% to approximately 1.0% by weight, based on total weight of the composition.

Anti-Redeposition Agents

The composition can include an anti-redeposition agent for facilitating sustained suspension of soils in a cleaning solution and preventing the removed soils from being redeposited onto the substrate being cleaned. Examples of suitable anti-redeposition agents include, but are not limited to: polyacrylates, styrene maleic anhydride polymers, cellulosic derivatives such as hydroxyethyl cellulose, hydroxypropyl cellulose and carboxymethyl cellulose. When the concentrate includes an anti-redeposition agent, the anti-redeposition agent can be included in an amount from approximately 0.5% to approximately 10% by weight, and from approximately 1% to approximately 5% by weight, based on total weight of the composition.

Stabilizing Agents

The composition may also include stabilizing agents. Examples of suitable stabilizing agents include, but are not limited to: borate, calcium/magnesium ions, propylene glycol, and mixtures thereof. The concentrate need not include a stabilizing agent, but when the concentrate includes a stabilizing agent, it can be included in an amount that provides the desired level of stability of the concentrate. Exemplary ranges of the stabilizing agent include up to approximately 20% by weight, from approximately 0.5% to approximately 20% by weight, from approximately 0.5% to approximately 15% by weight, and from approximately 2% to approximately 10% by weight, based on total weight of the composition.

Dispersants

The composition may also include dispersants. Examples of suitable dispersants that can be used in the composition include, but are not limited to: maleic acid/olefin polymers, polyacrylic acid, and mixtures thereof. The concentrate need not include a dispersant, but when a dispersant is included it can be included in an amount that provides the desired dispersant properties. Exemplary ranges of the dispersant in the concentrate can be up to approximately 20% by weight, from approximately 0.5% to approximately 20% by weight, from approximately 0.5% to approximately 15% by weight, and from approximately 2% to approximately 9% by weight, based on total weight of the composition.

Enzymes

Enzymes that can be included in the composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the composition is provided as a use composition. Exemplary ranges of the enzyme in the concentrate include up to approximately 15% by weight, from approximately 0.5% to approximately 15% by weight, from approximately 0.5% to approximately 10% by weight, and from approximately 1% to approximately 5% by weight, based on total weight of the composition.

Glass and Metal Corrosion Inhibitors

The solid detergent composition can include a metal corrosion inhibitor in an amount up to approximately 50% by weight, from approximately 1% to approximately 50% by weight, from approximately 1% to approximately 40% by weight, or from approximately 3% to approximately 30% by weight, based on total weight of the composition. The corrosion inhibitor is included in the solid detergent composition in an amount sufficient to provide a use solution that exhibits a rate of corrosion and/or etching of glass that is less than the rate of corrosion and/or etching of glass for an otherwise identical use solution except for the absence of the corrosion inhibitor. It is expected that the use solution will include at least approximately 6 parts per million (ppm) of the corrosion inhibitor to provide desired corrosion inhibition properties. It is expected that larger amounts of corrosion inhibitor can be used in the use solution without deleterious effects. It is expected that at a certain point, the additive effect of increased corrosion and/or etching resistance with increasing corrosion inhibitor concentration will be lost, and additional corrosion inhibitor will simply increase the cost of using the solid detergent composition. The use solution can include from approximately 6 ppm to approximately 300 ppm of the corrosion inhibitor, and from approximately 20 ppm to approximately 200 ppm of the corrosion inhibitor. Examples of suitable corrosion inhibitors include, but are not limited to: a combination of a source of aluminum ion and a source of zinc ion, as well as an alkali metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid detergent composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Exemplary sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Exemplary sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

The applicants discovered that by controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be at least approximately 6:1, can be less than approximately 1:20, and can be from approximately 2:1 to approximately 1:15.

Fragrances and Dyes

Various dyes, odorants including perfumes, and other aesthetic enhancing agents can also be included in the composition. Suitable dyes that may be included to alter the appearance of the composition, include, but are not limited to: Direct Blue 86, available from Mac Dye-Chem Industries, Ahmedabad, India; Fastusol Blue, available from Mobay Chemical Corporation, Pittsburgh, Pa.; Acid Orange 7, available from American Cyanamid Company, Wayne, N.J.; Basic Violet 10 and Sandolan Blue/Acid Blue 182, available from Sandoz, Princeton, N.J.; Acid Yellow 23, available from Chemos GmbH, Regenstauf, Germany; Acid Yellow 17, available from Sigma Chemical, St. Louis, Mo.; Sap Green and Metanil Yellow, available from Keyston Analine and Chemical, Chicago, Ill.; Acid Blue 9, available from Emerald Hilton Davis, LLC, Cincinnati, Ohio; Hisol Fast Red and Fluorescein, available from Capitol Color and Chemical Company, Newark, N.J.; and Acid Green 25, Ciba Specialty Chemicals Corporation, Greenboro, N.C.

Fragrances or perfumes that may be included in the compositions include, but are not limited to: terpenoids such as citronellol, aldehydes such as amyl cinnamaldehyde, a jasmine such as C1S-jasmine or jasmal, and vanillin. In an embodiment, the various dyes, odorants, and other aesthetic enhancing agents can be included in the composition in an amount from about 0.1% to about 5%, based on total weight of the composition.

Thickeners

The compositions can include a rheology modifier or a thickener. The rheology modifier may provide the following functions: increasing the viscosity of the compositions; increasing the particle size of liquid use compositions when dispensed through a spray nozzle; providing the use compositions with vertical cling to surfaces; providing particle suspension within the use compositions; or reducing the evaporation rate of the use compositions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact between substantial quantities of the film of the material with the soil for at least a minute, particularly five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol®, available from Dow Chemical, Philadelphia, Pa.; ALCOGUM® available from AkzoNobel, Chicago, Ill. and Carbopol®, available from Lubrizol Corporation, Wickliffe, Ohio.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the compositions further include polyvinyl alcohol thickeners, such as, fully hydrolyzed (greater than 98.5 mol acetate replaced with the —OH function).

An example of a particularly suitable polysaccharide includes, but is not limited to, xanthans. Such xanthan polymers are preferred due to their high water solubility, and great thickening power. Xanthan is an extracellular polysaccharide of *xanthomonas campestras*. Xanthan may be made by fermentation based on corn sugar or other corn sweetener byproducts. Xanthan comprises a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as $Al^{+3}$, $Fe^{+3}$, $Sb^{+3}$, $Zr^{+4}$ and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use composition that can produce large particle size mist or aerosol when sprayed. In an embodiment, the rheology modifiers and thickeners may be included in the composition in an amount from about 0.1 to about 5.0 weight %, based on total weight of the composition.

Methods of Manufacture

In general, the composition of the present invention can be created by combining the polysaccharide hybrid polymer, water, hydratable salt and any additional functional components and allowing the components to interact.

In one example, the polysaccharide hybrid polymer, water, hydratable salt and any additional functional components interact and harden into solid form. A stable hydrate solid is formed through the interaction of water, the hydrate salt, and the polysaccharide hybrid polymer. The solidification process may last from a few minutes to about six hours, depending on factors including, but not limited to: the size of the formed or cast composition, the ingredients of the composition, and the temperature of the composition.

The solid compositions may be formed using a batch or continuous mixing system. In an exemplary embodiment, a single- or twin-screw extruder is used to combine and mix one or more components at high shear to form a homogeneous mixture. In some embodiments, the processing temperature is at or below the melting temperature of the components. The processed mixture may be dispensed from the mixer and the solid composition created using forming, pressing, casting or other suitable means, whereupon the composition hardens to a solid form. The structure of the matrix may be characterized according to its hardness, melting point, material distribution, crystal structure, and other like properties according to known methods in the art. Generally, a solid composition processed according to the method of the invention is substantially homogeneous with regard to the distribution of ingredients throughout its mass and is dimensionally stable.

In an extrusion process, the liquid and solid components are introduced into final mixing system and are continuously mixed until the components form a substantially homogeneous semi-solid mixture in which the components are distributed throughout its mass. The mixture is then discharged from the mixing system into, or through, a die or other shaping means. The product is then packaged. In an exemplary embodiment, the formed composition begins to harden to a solid form in from approximately 1 minute to approximately 3 hours. Particularly, the formed composition begins to harden to a solid form in from approximately 1 minute to approximately 2 hours. More particularly, the formed composition begins to harden to a solid form in from approximately 1 minute to approximately 20 minutes.

In the pressing process, the liquid and solid components are introduced into the final mixing system and are mixed until the components form a substantially homogeneous semi-solid or powder mixture in which the components are distributed throughout its mass. The mixture is then discharged from the mixing system into a die or other rigid body and force is applied to the composition. The product is then packaged. The formed composition begins to harden during or after pressure is applied.

In a casting process, the liquid and solid components are introduced into the final mixing system and are continuously mixed until the components form a substantially homogeneous liquid mixture in which the components are distributed throughout its mass. In an exemplary embodiment, the components are mixed in the mixing system for at least approximately 60 seconds. Once the mixing is complete, the product is transferred to a packaging container where solidification takes place. In an exemplary embodiment, the cast composition begins to harden to a solid form in from approximately 1 minute to approximately 3 hours. Particularly, the cast composition begins to harden to a solid form in from approximately 1 minute to approximately 2 hours. More particularly, the cast composition begins to harden to a solid form in from approximately 1 minute to approximately 20 minutes.

By the term "solid", it is meant that the hardened composition will not flow and will substantially retain its shape under moderate stress or pressure or mere gravity. The degree of hardness of the solid cast composition may range from that of a fused solid product which is relatively dense and hard, for example, like concrete, to a consistency characterized as being a hardened paste. In addition, the term "solid" refers to the state of the composition under the expected conditions of storage and use of the solid composition. In general, it is expected that the composition will remain in solid form when exposed to temperatures of up to approximately 100° F. and particularly up to approximately 122° F.

The resulting solid composition may take forms including, but not limited to: a cast solid product; an extruded, molded or formed solid pellet, block, tablet, powder, granule, flake; or the formed solid can thereafter be ground or formed into a powder, granule, or flake. In an exemplary embodiment, extruded pellet materials formed by the detergent composition have a weight of from approximately 50 grams to approximately 250 grams, extruded solids formed by the composition have a weight of approximately 100 grams or greater, and solid block detergents formed by the composition have a mass of from approximately 1 to approximately 10 kilograms. The solid compositions provide for a stabilized source of functional materials. In some embodiments, the solid composition may be dissolved, for example, in an aqueous or other medium, to create a concentrated and/or use composition. The solution may be directed to a storage reservoir for later use and/or dilution, or may be applied directly to a point of use.

In certain embodiments, the solid composition is provided in the form of a unit dose. A unit dose refers to a solid composition unit sized so that the entire unit is used during a single washing cycle. When the solid composition is provided as a unit dose, it is typically provided as a cast solid, an extruded pellet, or a tablet having a size of from approximately 1 gram to approximately 50 grams.

In other embodiments, the solid composition is provided in the form of a multiple-use solid, such as a block or a plurality of pellets, and can be repeatedly used to generate aqueous compositions for multiple washing cycles. In certain embodiments, the solid composition is provided as a cast solid, an extruded block, or a tablet having a mass of from approximately 5 grams to approximately 10 kilograms. In certain embodiments, a multiple-use form of the solid composition has a mass from approximately 1 kilogram to approximately 10 kilograms. In further embodiments, a multiple-use form of the solid composition has a mass of from approximately 5 kilograms to about approximately 8 kilograms. In other embodiments, a multiple-use form of the solid composition has a mass of from about approximately 5 grams to approximately 1 kilogram, or from approximately 5 grams to approximately 500 grams.

Although the composition is discussed as being formed into a solid product, the composition may also be provided in the form of a paste or liquid. When the concentrate is provided in the form of a paste, enough water is added to the composition such that complete solidification of the composition is precluded. In addition, dispersants and other components may be incorporated into the composition in order to maintain a desired distribution of components.

Methods of Use

The solid detergent which may be added to an aqueous system or may be diluted to form concentrate or use compositions. In general, a concentrate refers to a composition that is intended to be added to or diluted with water, and the composition that contacts articles to be washed can be referred to as the use composition.

A use composition may be prepared from the concentrate by diluting the concentrate with water at a dilution ratio that provides a use composition having desired detersive properties. The water that is used to dilute the concentrate to form the use composition can be referred to as water of dilution or a dilutent, and can vary from one location to another. The use composition can also include additional functional ingredients at a level suitable for cleaning, rinsing, or the like.

The concentrate or use compositions may essentially include the polysaccharide hybrid polymer composition, water and the hydrate salt, as well as additional components such as, but not limited to, at least one alkali metal hydroxide, with the concentrate and use solutions differing in that the use composition includes a dilutent.

The typical dilution factor is from approximately 1 to approximately 10,000 but will depend on factors including water hardness, the amount of soil to be removed and the like. In one embodiment, the concentrate is diluted at a ratio of from about 1:10 to about 1:1000 concentrate to water. Particularly, the concentrate is diluted at a ratio of from about 1:100 to about 1:5000 concentrate to water. More particularly, the concentrate is diluted at a ratio of from about 1:250 to about 1:2000 concentrate to water.

A suitable concentration range of the components includes from about 1 to about 500 parts-per-million (ppm) of the polysaccharide hybrid polymer composition. A particularly suitable concentration range of the components includes from about 5 to about 500 parts-per-million (ppm) of the polysaccharide hybrid polymer composition. Another particularly suitable concentration range of the components includes from about 10 to about 100 ppm of the polysaccharide hybrid polymer composition.

The composition can contain an effective concentration of the alkali metal hydroxide so that the use composition has a pH of at least about 9. In one embodiment, the composition is a use composition that can be used to clean articles or substrates, such as glass, plastic, ceramic, and metal.

EXAMPLES

The present invention is more particularly described in the following examples that are intended as illustrations only, since numerous modifications and variations within the scope of the present invention will be apparent to those of skill in the art. Unless otherwise noted, all parts, percentages, and ratios reported in the following examples are on a weight bases, and all reagents used in the examples were obtained, or are available, from the chemical suppliers described below, or may be synthesized by conventional techniques.

Materials Used

EXP 1: a polysaccharide hybrid polymer composition containing about 50% by weight starch residue and 50% by weight methacrylic acid residue.

EXP 2: a polysaccharide hybrid polymer composition containing about 50% by weight starch residue, and 50% by weight synthetic monomers residue, of which 78.6% by weight methacrylic acid, 11.9% by weight monoalkyl maleate and 9.5% by weight hydroxyalkyl (meth)acrylate.

EXP 3: a polysaccharide hybrid polymer composition containing about 50% by weight polysaccharide residue and about 50% by weight synthetic monomers residue, of which 78.6% by weight acrylic acid, 11.9% by weight monomethyl maleate and 9.5% by weight hydroxypropyl methacrylate EXP 4: a polysaccharide hybrid polymer composition containing about 50% by weight polysaccharide, about 50% by weight synthetic monomers residue, of which 100% by weight acrylic acid.

25-R-2: Ethylene Oxide/Propylene Oxide Copolymer available from BASF Corporation (BASF).

Dehypon LS-36: Ethylene Oxide/Propylene Oxide Fatty Alcohol available from BASF.

Dequest 2010:1-hydroxyethylidene-1,1-diphosphonic acid available from ThermPhos.

Creating the Polysaccharide Hybrid Polymer Compositions

EXP 1 was created as follows: Maltodextrin of DE 18 (Cargill MD™ 01918, spray-dried maltodextrin obtained by enzymatic conversion of common corn starch, available from Cargill Inc., Cedar Rapids, Iowa) in an amount of 120 grams was dissolved in 440 grams of water and the mixture was heated to 90 C. Methacrylic acid in an amount of 120 grams was added to the reactor over a period of 1 hr. An initiator solution containing 6 grams of sodium persulfate in 80 grams of water was added to the reactor over a period of 1 hr and 10 minutes. The solution was cooked for 1 hr at 90 C. Next, 28 grams of 50% sodium hydroxide was added to the hazy, pale yellow solution. The final product was clear, light yellow solution and had 30.41% solids.

EXP 2 was created as follows: Monomethyl maleate (ester monomer) in an amount of 30.6 grams was dissolved in 130 grams of water. Sodium hydroxide (50%) in an amount of 3.52 grams was added and the mixture was heated to 87 C. Maltodextrin of DE 18 (Cargill MD™ 01918, spray-dried maltodextrin obtained by enzymatic conversion of common corn starch, available from Cargill Inc., Cedar Rapids, Iowa) in an amount of 169.95 grams was added just before the monomer and initiator feeds were started. A monomer solution containing a mixture of 133.93 grams of methacrylic acid and 27.25 grams of hydroxyethyl methacrylate (ester monomer) was added to the reactor over a period of 5 hours. A first initiator solution comprising of 21 grams of erythorbic acid dissolved in 99 grams of water was added over a period of 5.5 hours. A second initiator solution comprising of 21 grams of a 70% solution of tertiary butyl hydroperoxide dissolved in 109 grams of water was added over a period of 5.5 hours. The reaction product was held at 87° C. for 30 minutes. The final product was a yellowish amber solution and had 33.1% solids.

EXP 3 was created as follows: Monomethyl maleate (ester monomer) in an amount of 45.9 grams was dissolved in 388 grams of water. Ammonium hydroxide in an amount of 15.3 grams was added and the mixture was heated to 87 C. Maltodextrin of DE 18 (Cargill MD™ 01918, spray-dried maltodextrin obtained by enzymatic conversion of common corn starch, available from Cargill Inc., Cedar Rapids, Iowa) in an amount of 85 grams was added just before the monomer and initiator feeds were started. A monomer solution containing a mixture of 168 grams of acrylic acid and 41.0 grams of hydroxyethyl methacrylate (ester monomer) was added to the reactor over a period of 5 hours. A first initiator solution comprising of 21 grams of erythorbic acid dissolved in 99 grams of water was added over a period of 5.5 hours. A second initiator solution comprising of 21 grams of a 70% solution of tertiary butyl hydroperoxide dissolved in 109 grams of water was added over a period of 5.5 hours. The reaction product was held at 87° C. for 30 minutes. The final product was a clear light amber solution and had 34.1% solids.

EXP 4 was created as follows: A 2 liter reactor containing 538 grams of water and 280 grams of DE 10 maltodextrin was heated to 95° C. A monomer solution consisting of 280 grams of acrylic acid and 107 grams of water was added to the reactor over 2.5 hours. An initiator solution comprising of 37.3 grams of sodium persulfate in 118 grams of water was simultaneously added to the reactor over a period of 2.5 hours. The reaction product was held at 95° C. for an additional period of 1 hour. The polymer solution was partially neutralized by using 140.4 grams of 50% sodium hydroxide and then 0.2 grams of Proxel GXL was added as a biocide.

Dimensional Stability Test for Formed Products

A liquid premix was formed by mixing water and a polymer together. A powder premix was formed by mixing soda ash together in a separate container. The liquid premix was gradually added to the powder premix while stirring to achieve a homogeneous product. Immediately after mixing, approximately 50 gram of the product was pressed in a die at approximately 1000 pounds per square inch (psi) for approximately 20 seconds to form tablets. After storage for one hour at room temperature, the diameter and height of each tablet was measured and recorded.

The tablets were formed in duplicate. One tablet was placed in an oven at 100° F. and the other tablet was placed in an oven at 122° F. The diameter and height of each tablet was measured and recorded after one week and two weeks of storage in the respective oven. The diameters and heights were measured by digital calipers. The tablets were considered to exhibit dimensional stability if there was a combined diameter and height swelling or growth of less than approximately 3%, and particularly less than approximately 2%.

Sample 1

Sample 1 is a composition of the present invention using a polysaccharide hybrid polymer composition including residue of starch and residue of methacrylic acid. Table 1 provides the component concentrations, in grams, for the composition of Sample 1.

TABLE 1

| | Sample 1 |
|---|---|
| Dense Ash | 72 |
| Mono Ash, 15% active | 11.3 |
| Soft water | 2.69 |
| EXP 2, 33.14% active | 14.48 |

The composition of Sample 1 was formed into tablets as described above and then subjected to the dimensional stability test for formed products to observe the dimensional stability of the compositions after heating. Less than about 3% swelling and particularly less than about 2% swelling of the diameter and height combined demonstrates dimensional stability. The results after one week of storage are tabulated below in Table 2; the results after two weeks of storage are in Table 3.

TABLE 2

| | Temp (F) | % Growth (Diameter) | % Growth (Height) | % Average Growth |
|---|---|---|---|---|
| Sample 1 | 100 | 1.52 | 1.83 | 1.67 |
| Sample 1 | 120 | 1.34 | 1.44 | 1.39 |

TABLE 3

| | Temp (F) | % Growth (Diameter) | % Growth (Height) | % Average Growth |
|---|---|---|---|---|
| Sample 1 | 100 | 1.65 | 1.88 | 1.77 |
| Sample 1 | 120 | 1.52 | 1.34 | 1.43 |

As illustrated in Tables 2 and 3, the formed products of Sample 1 exhibited a low degree of swelling. In particular, after two weeks, and under the most extreme conditions (122 F), Sample 1, which included a polysaccharide hybrid polymer composition containing residue of starch and residue of methacrylic acid, swelled 1.43%.

Samples 2-5 and Comparative Samples A-B

Once it was determined that dense ash and mono ash combined with a polysaccharide hybrid polymer composition formed a dimensionally stable solid product, light ash was also investigated. Additionally, a second polysaccharide hybrid polymer composition containing residue of methacrylic acid was used in Samples 4 and 5 in place of polymer EXP 2.

Table 4 provides the component concentrations, in grams, for Samples 2-5 and Comparative Samples A-B.

TABLE 4

| | Comp Smpl A | Comp Smpl B | Smpl 2 | Smpl 3 | Smpl 4 | Smpl 5 |
|---|---|---|---|---|---|---|
| Dense Ash | 72 | 72.12 | 72 | 72.12 | 72 | 72.12 |
| Light Ash | | 10.19 | | 10.19 | | 10.19 |
| Mono Ash, 15% active | 11.3 | | 11.3 | | 11.3 | |
| Soft water | 12.404 | 11.43 | 1.33 | 0.23 | 1.35 | 0.15 |
| EXP 2, 33.14% | | | 14.48 | 14.79 | | |
| EXP 1, 30.4% active | | | | | 15.79 | 16.12 |
| NaOH, 50% | | | 2.73 | 2.58 | | |
| Total | 95.7 | 93.7 | 101.8 | 99.9 | 100.4 | 98.6 |

The compositions of Examples 2-5 were formed into tablets as described above and then subjected to the dimensional stability test for formed products to observe the dimensional stability of the compositions after heating. The results after one week of storage are tabulated below in Table 5 and in Table 6 for after two weeks of storage.

Comparative Samples A-B could not be formed into tablets and thus no results are provided for these tablets in Tables 5 and 6.

TABLE 5

| | Temp (F) | % Growth (Diameter) | % Growth (Height) | Average % Growth |
|---|---|---|---|---|
| Comp. Sample A | 100° | — | — | — |
| Comp. Sample A | 122° | — | — | — |
| Comp. Sample B | 100° | — | — | — |
| Comp. Sample B | 122° | — | — | — |
| Sample 2 | 100° | 1.34 | 1.47 | 1.4 |
| Sample 2 | 122° | 1.86 | 3.09 | 2.47 |
| Sample 3 | 100° | 0.93 | 0.85 | 0.89 |
| Sample 3 | 122° | 1.79 | 1.55 | 1.67 |
| Sample 4 | 100° | 1.25 | 1.58 | 1.42 |
| Sample 4 | 122° | 1.03 | 1.28 | 1.16 |
| Sample 5 | 100° | 1.46 | 1.59 | 1.53 |
| Sample 5 | 122° | 0.94 | 1.45 | 1.19 |

TABLE 6

| | Temp (F) | % Growth (Diameter) | % Growth (Height) | Average % Growth |
|---|---|---|---|---|
| Comp. Sample A | 100° | — | — | — |
| Comp. Sample A | 122° | — | — | — |
| Comp. Sample B | 100° | — | — | — |
| Comp. Sample B | 122° | — | — | — |
| Sample 2 | 100° | 1.51 | 1.26 | 1.39 |
| Sample 2 | 122° | 1.88 | 3.09 | 2.48 |
| Sample 3 | 100° | 0.8 | 1.05 | 0.92 |
| Sample 3 | 122° | 1.81 | 1.35 | 1.58 |
| Sample 4 | 100° | 1.28 | 1.54 | 1.41 |
| Sample 4 | 122° | 1.01 | 1.24 | 1.12 |
| Sample 5 | 100° | 1.48 | 1.55 | 1.51 |
| Sample 5 | 122° | 1.14 | 1.4 | 1.27 |

As discussed above, Comparative Samples A and B, which did not contain a polymer, could not be formed into tablets. In comparison, Samples 2-5 contained a polysaccharide hybrid polymer composition and could be formed into tablets. After two weeks under the most extreme conditions (122 F), Sample 2, which included polymer EXP 2 and mono ash, swelled 2.48%, and Sample 3, which included polymer EXP 2 and light ash, swelled 1.58%. Compositions including polymer EXP 1 also produced favorable tablets. Sample 4, which included mono ash, swelled 1.12%, and Sample 5, which included light ash, swelled 1.27%.

Samples 7-10

Experimental polysaccharide hybrid polymer compositions EXP 3 and EXP 4 were also investigated. EXP 3 included acrylic acid, monoalkyl maleate, and hydroxyalkyl (meth)acrylate, and EXP 4 included acrylic acid.

Table 7 provides the component concentrations, in grams, for Samples 7-10.

TABLE 7

| | Sample 7 | Sample 8 | Sample 9 | Sample 10 |
|---|---|---|---|---|
| Dense Ash | 72 | 72.12 | 72 | 72.12 |
| Light Ash | | 10.19 | | 10.19 |
| Mono Ash, 15% | 11.3 | | 11.3 | |
| Soft water | 6.3 | 5.16 | 5.2 | 2.81 |
| EXP 3, 44% | 10.9 | 11.19 | | |
| EXP 4, 40% | | | 12 | 12 |
| Total | 100.5 | 98.66 | 100.5 | 97.12 |

The compositions of Examples 7-10 were formed into tablets as described above and then subjected to the dimensional stability test for formed products to observe the dimensional stability of the compositions after heating. The results after 24 hours, one week, and two weeks of storage are tabulated below in Table 8, Table 9, and Table 10, respectively.

TABLE 8

| | Temp (F) | % Growth (Diameter) | % Growth (Height) | Average % Growth |
|---|---|---|---|---|
| Sample 7 | 100° | 0.13 | 0.2 | 0.17 |
| Sample 7 | 122° | 1.25 | 1.65 | 1.45 |
| Sample 8 | 100° | 0.22 | −0.25 | −0.01 |
| Sample 8 | 122° | 1.99 | 2.03 | 2.01 |
| Sample 9 | 100° | 1.22 | 1.08 | 1.15 |
| Sample 9 | 122° | 1.94 | 2.04 | 1.99 |
| Sample 10 | 100° | 1.16 | 1.18 | 1.17 |
| Sample 10 | 122° | 1.87 | 1.95 | 1.91 |

TABLE 9

| | Temp (F) | % Growth (Diameter) | % Growth (Height) | Average % Growth |
|---|---|---|---|---|
| Sample 7 | 100° | 0.93 | 1.06 | 1 |
| Sample 7 | 122° | 1.86 | 2.16 | 2.01 |
| Sample 8 | 100° | 1.46 | 1.3 | 1.38 |
| Sample 8 | 122° | 2.83 | 2.87 | 2.85 |
| Sample 9 | 100° | 1.54 | 2.99 | 2.27 |
| Sample 9 | 122° | 2.58 | 2.93 | 2.76 |
| Sample 10 | 100° | 2.25 | 1.91 | 2.08 |
| Sample 10 | 122° | 2.94 | 3.12 | 3.03 |

TABLE 10

| | Temp (F) | % Growth (Diameter) | % Growth (Height) | Average % Growth |
|---|---|---|---|---|
| Sample 7 | 100° | 1.11 | 1.37 | 1.24 |
| Sample 7 | 122° | 1.72 | 2.26 | 1.99 |
| Sample 8 | 100° | 1.7 | 1.24 | 1.47 |
| Sample 8 | 122° | 2.63 | 2.97 | 2.8 |
| Sample 9 | 100° | 1.78 | 1.8 | 1.79 |
| Sample 9 | 122° | 2.45 | 2.93 | 2.69 |
| Sample 10 | 100° | 2.41 | 2.08 | 2.24 |
| Sample 10 | 122° | 2.76 | 3.07 | 2.91 |

After two weeks under the most extreme conditions (122 F), Samples 7, 8, 9 and 10 experienced less than 3% average growth.

Samples 11 and 12 and Comparative Sample C

EXP 3 and EXP 4 were further investigated in combination with 25-R-2. Table 11 provides the component concentrations, in grams, for Samples 11 and 12 and Comparative Sample C, which did not include a polysaccharide hybrid polymer composition.

TABLE 11

| | Comp Sample C | Sample 11 | Sample 12 |
|---|---|---|---|
| Dense Ash | 82.3 | 78.7 | 92 |
| Soft water | 3.02 | | |
| Dequest 2010, 60% | 1 | 1 | 1 |
| KOH, 45% | 8.89 | | |
| Dehypon LS-36 | 3.68 | 3.68 | 3.68 |
| Pluronic 25-R-2 | 1.11 | 1.11 | 1.11 |
| EXP 3, 44% | | 13.64 | |
| EXP 4, 40% | | | 15 |
| Total | 100 | 98.13 | 112.79 |

Samples 11 and 12 and Comparative Sample C were formed into tablets as described above and then subjected to the dimensional stability test for formed products to observe the dimensional stability of the compositions after heating. The results after 24 hours, one week and two weeks of storage are tabulated below in Table 12, Table 13 and Table 14, respectively.

TABLE 12

| | Temp (F) | % Growth (Diameter) | % Growth (Height) | Average % Growth |
|---|---|---|---|---|
| Comp Sample C | 100° | 0.53 | 0.64 | 0.59 |
| Comp Sample C | 122° | 3.69 | 2.7 | 3.20 |
| Sample 11 | 100° | 0.51 | 1.31 | 0.91 |
| Sample 11 | 122° | 2.03 | 2.11 | 2.07 |
| Sample 12 | 100° | 2.69 | 0.47 | 1.58 |
| Sample 12 | 122° | 1.22 | 1.93 | 1.58 |

TABLE 13

| | Temp (F) | % Growth (Diameter) | % Growth (Height) | Average % Growth |
|---|---|---|---|---|
| Comp Sample C | 100° | 9.65 | 10.15 | 9.90 |
| Comp Sample C | 122° | 40.62 | 47.91 | 44.26 |
| Sample 11 | 100° | 1.11 | 1.47 | 1.29 |
| Sample 11 | 122° | 2.30 | 2.53 | 2.42 |
| Sample 12 | 100° | 1.82 | 0.89 | 1.36 |
| Sample 12 | 122° | 1.36 | 2.30 | 1.83 |

TABLE 14

| | Temp (F) | % Growth (Diameter) | % Growth (Height) | Average % Growth |
|---|---|---|---|---|
| Comp Sample C | 100° | 12.95 | 15.31 | 14.13 |
| Comp Sample C | 122° | 47.82 | 57.39 | 52.61 |
| Sample 11 | 100° | 1.18 | 1.89 | 1.53 |
| Sample 11 | 122° | 2.35 | 2.64 | 2.49 |
| Sample 12 | 100° | 0.87 | 0.84 | 0.85 |
| Sample 12 | 122° | 1.51 | 2.35 | 1.93 |

After two weeks at the most extreme conditions (122 F), Samples 11 and 12, which included a polysaccharide hybrid polymer composition, experienced less than 3% average growth. Comparative Sample C, which did not include a polysaccharide hybrid polymer composition had an average growth of greater than 50%.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

What is claimed is:

1. A solid detergent composition comprising:

a polysaccharide hybrid polymer composition present in an amount from about 1% to about 20% by weight of the solid detergent composition, wherein the polysaccharide hybrid polymer composition comprises:

residue of a polysaccharide present in an amount from about 5% to about 90% by weight of the polysaccharide hybrid polymer composition; and residue of at least one ethylenically unsaturated monomer present in an amount from about 10% to about 75% by weight of the polysaccharide hybrid polymer composition;

a nonionic surfactant comprising an alcohol ethoxylate propoxylate, an ethylene oxide/propylene oxide block copolymer, or combinations of the same;

a hydratable salt present in an amount of about 40% or greater by weight of the solid detergent composition; and water present in an amount of about 2% to about 40% by weight of the solid detergent composition.

2. The solid detergent composition of claim 1, wherein if the solid detergent composition is stored at 122 degrees Fahrenheit for seven days it has an average growth less than 3%.

3. The solid detergent composition of claim 1, and further comprising phosphorous present in an amount from 0% to 0,5% by weight of the solid detergent composition.

4. The solid detergent composition of claim 1, wherein the at least one ethylenically unsaturated monomer includes at least one anionic ethylenically unsaturated monomer.

5. The solid detergent composition of claim 1, wherein the at least one ethylenically unsaturated monomer includes at least one member selected from the group consisting of acrylic acid, methacrylic acid, ethacrylic acid, α-chloro-acrylic acid, α-cyano acrylic acid, β-acryloxy propionic acid, sorbic acid, α-chloro sorbic acid, angelic acid, Cinnamic acid, p-chloro Cinnamic acid, β-styryl acrylic acid (1-carboxy-4-phenyl butadience-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, monomethyl maleate, and salts and combinations thereof.

6. The solid detergent composition of claim 5, wherein the at least one ethylenically unsaturated monomer includes at least one member selected from the group consisting of acrylic acid, maleic acid, methacrylic acid, 2-acrylamido-2-methyl propane sulfonic acid, monomethyl maleate and salts and combinations thereof.

7. The solid detergent composition of claim 1, wherein the solid detergent composition consists essentially of:

the polysaccharide hybrid polymer composition present in an amount from about 1% to about 20% by weight of the solid detergent composition;

the hydratable salt present in an amount of about 40% or greater by weight of the solid detergent composition;

the nonionic surfactant selected from the group consisting of an alcohol ethoxylate propoxylate, an ethylene oxide/propylene oxide block copolymer, and combinations of the same;

water present in an amount of about 2% to about 40% by weight of the solid detergent composition;

phosphorous present in an amount from 0% to 0.5% by weight of the solid detergent composition; and at least one functional ingredient.

8. The solid detergent composition of claim 1, wherein the polysaccharide hybrid polymer composition further comprises a hydrophilic monomer.

9. The solid detergent composition of claim 1 wherein the polysaccharide hybrid polymer composition further comprises at least one member selected from the group consisting of monoalkyl maleate and hydroxyalkyl (meth)acrylate.

10. The solid detergent composition of claim 1, wherein the polysaccharide hybrid polymer composition includes from about 10% to about 80% by weight biobased content.

11. The solid detergent composition of claim 1, further comprising about 5% or less sodium hydroxide by weight of the solid detergent.

12. A method of forming a hydrate solid, the method comprising:

mixing a nonionic surfactant comprising an alcohol ethoxylate propoxylate, an ethylene oxide/propylene oxide block copolymer, or combinations of the same, water and a polysaccharide hybrid polymer composition to form a liquid premix, wherein the polysaccharide hybrid polymer composition includes a polysaccharide and at least one ethylenically unsaturated monomer or salts thereof; and adding the liquid premix to at least one hydratable salt to form a mixture; and forming a hydrate solid from the mixture, wherein water is present in an amount of about 2% to about 40% by weight of the hydrate solid.

13. The method of claim 12, wherein if the hydrate solid is stored at 122 degrees Fahrenheit for 7 days it has an average growth exponent of less than 3%.

14. The method of claim 12, wherein the hydrate solid further comprises about 0.5% or less phosphorus by weight of the hydrate solid.

15. The method of claim 12, wherein the liquid premix comprises the polysaccharide hybrid polymer composition in an amount from about 1% to about 20% by weight of the hydrate solid, and wherein adding the liquid premix to hydratable salt includes adding the liquid premix to about 40% or greater hydratable salt by weight of the hydrate solid.

16. The method of claim 12, wherein the at least one ethylenically unsaturated monomer includes at least one anionic ethylenically unsaturated monomer.

17. The method of claim 12, wherein the at least one ethylenically unsaturated monomer includes at least one member selected from the group consisting of acrylic acid, methacrylic acid, ethacrylic acid, α-chloro-acrylic acid, α-cyano acrylic acid, β-methyl-acrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid, monomethyl maleate, and salts and combinations thereof.

18. A method of cleaning a substrate, the method comprising:

mixing water with a solid composition to form a use solution, the solid composition comprising:

a polysaccharide hybrid polymer composition present in an amount from about 1% to about 20% by weight of the solid composition, the polysaccharide hybrid polymer composition comprising residue of a polysaccharide present in an amount from about 5% to about 90% by weight of the polysaccharide hybrid polymer composition and residue of at least one ethylenically unsaturated monomer present in an amount from about 10% to about 75% by weight of the polysaccharide hybrid polymer composition;

a nonionic surfactant comprising an alcohol ethoxylate propoxylate, an ethylene oxide/propylene oxide block copolymer, or combinations of the same, a hydratable salt present in an amount of about 40% or greater by weight of the solid composition; and water present in an amount of about 2% to about 40% by weight of the solid composition; and contacting the substrate with the use solution.

19. The method of claim 18, wherein the polysaccharide hybrid polymer composition is present in the use solution in an amount from about 5 ppm to about 500 ppm.

20. The method of claim 18, wherein the use solution has a pH of at least 9.0.

21. The method of claim 18, wherein the at least one ethylenically unsaturated monomer includes at least one anionic ethylenically unsaturated monomer.

22. The method of claim 18, wherein the at least one ethylenically unsaturated monomer is selected from the group consisting of acrylic acid, methacrylic acid, ethacrylic acid, α-chloro-acrylic acid, α-cyano acrylic acid, β-methylacrylic acid (crotonic acid), α-phenyl acrylic acid, β-acryloxy propionic acid, sorbic acid, α-chloro sorbic acid, angelic acid, cinnamic acid, p-chloro cinnamic acid, β-styryl acrylic acid (1-carboxy-4-phenyl butadiene-1,3), itaconic acid, maleic acid, citraconic acid, mesaconic acid, glutaconic acid, aconitic acid, fumaric acid, tricarboxy ethylene, 2-acryloxypropionic acid, 2-acrylamido-2-methyl propane sulfonic acid, vinyl sulfonic acid, sodium methallyl sulfonate, sulfonated styrene, allyloxybenzene sulfonic acid, mono ethyl maleate, and salts and combinations thereof.

23. The method of claim 18, Wherein the at least one ethylenically unsaturated monomer is selected from the group consisting of acrylic acid, maleic acid, methacrylic acid, 2-acrylamido-2-methyl propane sulfonic acid and salts and combinations thereof.

24. The method of claim 18, Wherein if stored at 122 degrees Fahrenheit for seven days the solid composition has an average growth less than 3%.

25. The method of claim 18, wherein the polysaccharide hybrid polymer composition further includes phosphorous present in an amount from 0% to 0.5% by weight of the solid composition.

* * * * *